United States Patent [19]

Dinter et al.

[11] 4,116,162

[45] Sep. 26, 1978

[54] COATING DEVICE

[75] Inventors: Peter Dinter, Hallgarten; Andreas Kolbe, Wiesbaden; Reinhold Guckes, Hohenstein, all of Germany

[73] Assignee: Hoechst Aktiengesellschaft, Frankfurt am Main, Germany

[21] Appl. No.: 829,425

[22] Filed: Aug. 31, 1977

[51] Int. Cl.[2] ..... B05C 1/08; B05C 11/10; B05C 3/18

[52] U.S. Cl. ..... 118/104; 118/203; 118/261; 118/419

[58] Field of Search ..... 118/244, 258, 261, 262, 118/216, 110, 203, 243, DIG. 15, DIG. 17, 419, 423, 428, 429, 104, 118, 108

[56] References Cited

U.S. PATENT DOCUMENTS

| | | | |
|---|---|---|---|
| 1,473,594 | 11/1923 | Jenne | 118/258 |
| 1,608,484 | 11/1926 | Andrews | 118/419 |
| 2,642,032 | 6/1953 | Osgood | 118/261 X |
| 3,031,872 | 5/1962 | Kusters | 118/104 |
| 3,083,685 | 4/1963 | Colgan | 118/410 |
| 3,179,083 | 4/1965 | Warner | 118/104 |
| 3,304,910 | 2/1967 | Warner | 118/104 |
| 3,461,837 | 8/1969 | Dreher | 118/50 |
| 3,826,228 | 7/1974 | Glover | 118/203 X |

FOREIGN PATENT DOCUMENTS

| | | |
|---|---|---|
| 1,192,515 | 5/1970 | France. |
| 1,652,402 | 11/1971 | Fed. Rep. of Germany. |
| 385,195 | 6/1976 | Sweden. |

*Primary Examiner*—Louis K. Rimrodt
*Attorney, Agent, or Firm*—Richard L. Schwaab

[57] ABSTRACT

Apparatus for coating moving web material includes an open trough containing a fluid coating agent over which a tensioned web to be coated travels. A pair of rotatable doctor rods are supported by the narrow edge areas of open channels across which the rods lie, the channels and the doctor rods extending widthwise parallel to the trough and adjacent each side thereof, with the rods forming upright extensions of the opposite sidewalls of the trough, so that the web contacts the rods sequentially as it traverses the trough. The rod on the far side of the trough relative to the moving web wipes the coating picked up from the trough by the web to desired thickness, and the channel support for the rod enables the rod to be wiped and cleaned by the narrow edge areas, which may be made from replaceable thin doctor strips that extend beyond the channel sidewalls. The trough and channels can be formed from a unitary base block that is adjustable relative to tension guide means for the web, the doctors rods may be of different sizes, and the doctor rods may be hollow to accommodate a heat exchange medium.

19 Claims, 5 Drawing Figures

COATING DEVICE

FIELD OF THE INVENTION

This invention is an improvement in apparatus for coating traveling web material.

BACKGROUND OF THE INVENTION

The invention relates to a coating device for the continuous coating of driven web materials such as, for example, paper webs or metal webs, but preferably film webs of plastics or regenerated cellulose. The coating agents can be, for example, dispersions, emulsions, solutions, hot-melt adhesives and the like.

In the paper and film finishing industry, a plurality of very diverse technologies for coating travelling material webs has found acceptance. Thus, for example, a so-called doctor roll applicator, as described in German Offenlegungsschriften Nos. 1,577,647 and 2,034,004 is employed. FIG. 2 of the first-mentioned Offenlegungsschrift illustrates very well the mode of action of such processes. Thus, an excess of coating agent is first applied, by means of a feed roll which runs in the direction of, or counter to, the web travel and dips into an applicator trough filled with coating substance for applying the substance onto the substrate to be coated, for example a web of paper, film or metal. The necessary adjustment to give the particular desired coating weight is then effected immediately afterwards by a downstream doctor roll, usually a rotating circular rod which may be smooth or may sometimes also be wound with wires of very diverse thicknesses. This rod, in the latter case, also is known in the art under the English specialist term "wirebar".

These devices, for example exemplified by German Offenlegungsschrift No. 1,577,647, which employ freely mounted rods, the diameter of which is approximately of the order of 40 mm, however, suffer from disadvantages, predominately due to processing technology problems. Thus, for example, a contamination of the doctor rod by adhering, dried-out coating material is encountered, resulting in impairment of the quality of the coating, and the formation of streaks and imperfections.

As the art has progressed, exemplary devices which are customary at the present time are illustrated in German Offenlegungsschriften Nos. 2,034,004 and 2,307,404. Characteristic features of these systems are the substantially reduced doctor rod diameters, the mounting of the doctor rod in a doctor bed which supports it over its entire length and in part surrounds it, as well as devices for keeping the rotating rod clean, the latter devices being in the form of wiping edges and flushing grooves.

In spite of these developments, these devices still exhibit substantial shortcomings which hinder their universal application. A disadvantage is to be found, particularly, in the combination of the new metering device with the conventional feed system in the form of dip rolls, transfer rolls and/or applicator rolls. This circumstance manifests itself as a troublesome factor particularly in high speed coating using coating substances which are sensitive to external influences, for example polyvinylidene dispersions which are sensitive to shear and tend to form coagulate and foam. At the desired web speeds of 300 to 400 m/minute, the feed roll, which the machinery manufacturers traditionally like to make of large size for example with diameters of 200 mm and above, must of course also run at high speed in order to ensure that excess material is applied. The consequences are that, in a very short time, mountains of foam are generated in the applicator trough and, as a consequence, a blistered coating of inferior quality is produced.

However, attempted counter-measures in the form of a reduction of the diameter of the feed rolls have exactly the opposite effect. Smaller rolls must, since they have a lesser contact surface, be operated at correspondingly higher speeds of revolution with a view to comparable application weights of coating material compared with a large roll.

Modifying the roll surface by grooving, providing a screen-type surface, or equivalent approaches, which normally lead to the expectation of a higher feed rate, do not produce the desired effect from the point of view of enabling the lowering the speed of rotation of the rolls.

To circumvent the problems described, an emergency solution has been adopted in most cases; namely, constant and repeated circulation of the coating substance by pumping. However, this step undoubtedly amounts to an additional harmful treatment of the coating agent, even if the pumping circulation of the material is, inter alia, effected relatively gently by means of suitable conveying units such as membrane pumps.

In addition to the disadvantages described, emanating from the process, the actual doctor roll system also suffers from disadvantages resulting from the technical aspects of the apparatus. These include, inter alia, the preferred use of doctor beds made of plastics, such as, for example, polyethylene, polypropylene, polyamide, polytetrafluoroethylene and the like, and also of rubber-like materials.

The doctor bed profiles which are subject to wear and hence can only be employed for a limited time are either extruded as a profile, or cast, or produced from solid material by mechanical machining processes such as milling, planing, drilling and the like, and are produced in separate manufacturing operations. The fact that these manufacturing methods are costly is understandable, and in view of the fact that the spent doctors have to be thrown away, the methods are not economical, particularly since this situation influences the continuous total operating costs for coating, and since downtimes have to be tolerated.

It is not infrequently the case that the temperature-conditioning, that is to say both cooling and heating, of the coating substance and of the equipment is a technological necessity. The poor heat conductivity properties of the plastic doctor beds however in such a situation also prevent optimum operating temperatures being set up, which must be regarded as a further disadvantage of the conventional applicator systems.

A further shortcoming of the known apparatuses is to be seen in the flushing circuits for keeping the doctor rods clean.

Since, according to experience, no complete sealing of these systems is achievable, it is entirely possible that the flushing medium will come into contact with the coating substance. In the case of, for example, polyvinylidene coating, contact with water, which is the preferentially used flushing agent, can lead to precipitation of the dispersion. Obviously, similar occurrences can also not be excluded in the case of reactive adhesive mixtures or solutions. The coagulate sludge thus produced on the one hand blocks the flushing channels and can moreover even be carried by the rotating doctor rod into the plastic bed, making the latter unusable.

Accordingly, the object presented itself of developing a coating device which constitutes a technical advance and in which the indicated disadvantages and shortcomings of the device of the prior art are avoided.

SUMMARY OF THE INVENTION

This invention comprises a device for continuously coating tensioned travelling material webs with flowable coating agents, in which device an applicator trough and a doctor rod are present, and which is characterised in that, viewed in the direction of travel of the web, two parallel channels, respectively in front and behind the applicator trough, which is closed by end plates at the end side walls, communicate with the said trough, the side walls of the channels being matched to the radius of the doctor rods which they guide, and the width of the channels being less than the diameter of the doctor rods which project beyond the side walls of the channels.

In practice, it has been found that inclining the channels relative to the applicator trough has proved successful. In this case it is preferred that the channels are so arranged relative to the applicator trough that the resultant of the parallelogram of forces, which results from the magnitude and direction of the forces acting on the doctor rods and which result from the running of the web, is directed, at least approximately, to the center of the channels. For this reason, the channel openings are inclined away from the trough.

The forces result from the tensional stress and the selected wrap-round angle of the material web ( FIGS. 2 and 3). The inclined position has the effect that in the case of very rapid coating processes, or when using very viscous coating agents or doctor rods of fairly large diameter, the doctor rods are prevented from jumping out of the guides.

Although the channels can have any shape, as long as they fulfill the requirement of supporting and guiding the doctor rods, rectangular or square cross-sections of the channels have proved particularly successful in practice, since these are relatively simple to manufacture.

Although a wiping effect is achieved merely by the narrow edge areas of the channels in contact with the rods, it is nevertheless advantageous to insert sheet metal doctor strips, preferably of a springy material, into the channels along the sidewalls, the strips preferably projecting between 0.1 and 3.0 mm above the upper edge of the sidewalls of the channels.

Advantageously, the sheet metal doctor strips are mounted on both sides over the entire length of the channels and are either curved profiles and appropriately matched to the channel cross-section or, if they are used as individual metal sheets, are pressed against the walls of the channels by a clamping strip.

It is also possible to use a plurality of metal doctor strips side by side: the preferred thickness of the strips is from 0.02 to 0.5 mm. The metal doctor strips ensure that the edges of the channels do not wear as a result of the rubbing action of the doctor rods, which would reduce the life of the apparatus. When the strips have become worn down to the height of the upper edge of the channel sidewalls, they can easily be replaced, and the resulting material costs are only slight. The springy action of the metal doctor strips furthermore achieves a good and constant cleaning effect on the doctor rods.

In order to achieve good running of the doctor rods, the latter are preferably driven; it is preferred that they are driven in counterotation, so that any dirt which may adhere to the doctor rod is in every case scraped off outwards and cannot enter the applicator trough. For this purpose, the rods are driven so that their surface areas opposite their supporting channels move away from each other when the rods are rotated.

The diameter of the doctor rods is in general from 5 to 50 mm, but preferably from 10 to 25 mm. For particularly good control of the amount applied it has proved advantageous to have the doctor rods of different diameter, with the doctor rod which, viewed in the direction of travel of the web, is behind the applicator trough, having the larger diameter.

In practice, it has proved advantageous to accommodate the applicator trough and the channels in a unitary base block so that the stability of the apparatus is increased and further technical measures can be carried out. Thus it has been found that when using viscous coating agents, heating is advantageous. For this purpose bores are machined in the base block, through which a heat exchange medium, for example hot water, can be passed. This warms the coating agent and a decrease in viscosity occurs, which contributes to an improvement of the coating. Equally, the doctor rods can be provided with bores, to make it possible to pass a heating medium through them. Advantageously, the doctor rods are in that case constructed as tubes.

The coating agent can be fed into the applicator trough by, for example, pouring in from above, or allowing it to run in continuously.

In one particular embodiment, the coating agent is, however, fed in from below, specifically through bores made in the base block and in communication with the applicator trough, preferably though a pressure equalizing channel and slit which extend lengthwise along the applicator trough.

Since normally the guide rolls over which the webs are led in front of and behind the coating device can only be height-adjusted with great effort, it has proved advantageous in practice to provide the base block with a height adjustment device for adjusting the position of the block relative to the web guide rolls. This allows an optimum setting of the tension relationships between the doctor rods and the web guide, and the entire device can be moved away from the normal plane of the web, for example in order to carry out repair work on the coating device, such as replacing the metal doctor strips. For special purposes, it has proved advantageous to wrap the doctor rods with wires, as is known from the prior art.

Depending on the composition of the coating agent, it is necessary to produce the entire apparatus, or parts thereof, from materials which do not suffer corrosion by the coating agent. Above all, plastics or stainless steels have proved particularly suitable for this purpose. This applies especially to the applicator trough and to the doctor rods and metal doctor strips.

The device according to the invention has proved excellent for coating, especially for coating material webs travelling at high speeds of up to about 300–400 m/minute. It is possible by means of the device to coat all coatable material webs, for example of paper or metal, but especially webs of plastics or regenerated cellulose.

DESCRIPTION OF THE DRAWINGS

The coating device and its mode of action will now be explained in more detail with the aid of the figures which follow, but the invention is not limited to the illustrated embodiments shown. With reference to the drawings.

DETAILED DESCRIPTION OF THE INVENTION

Figure 1:
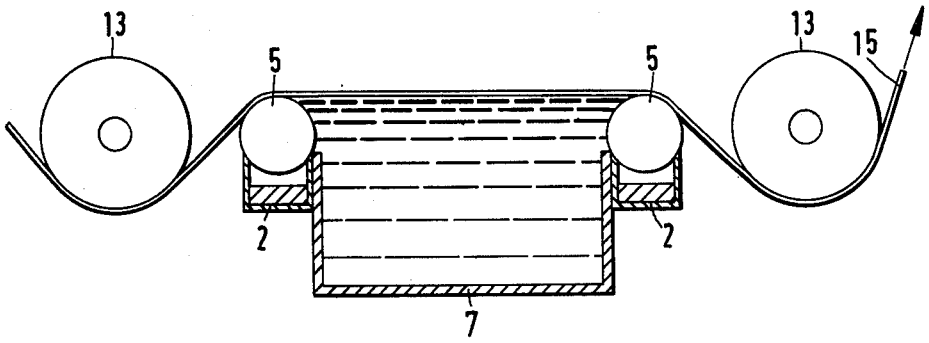
FIG. 1 schematically shows, in side view in cross-section, the simplest embodiment of the device.

In FIG. 1, the tensioned web 15 to be coated runs over the first hold-down guide roll 13 which is offset from the coating device, and subsequently over the metal doctor rods 5, which are supported by narrow edge areas of channels 2 and which in effect form part of the sidewalls of the applicator trough 7, since the rods extend beyond the sidewalls of the trough. The second hold-down roll 13 on the far side of the trough relative to the moving web is also offset from the coating device so that the web runs in tension over the doctor rods. The coating agent is located in the applicator trough 7 and preferably comes up to the level of the upper edge of the rods 5. The web picks up the coating material from the trough 7 as it traverses the latter, and the coating material is wiped to desired thickness by the doctor rod 5 located on the far side of the trough relative to the moving web 15. The purpose of the channels 2 supporting the doctor rods 5 will become more apparent in connection with the description of the embodiment of the invention shown in FIGS. 2 and 3.

Figure 2:
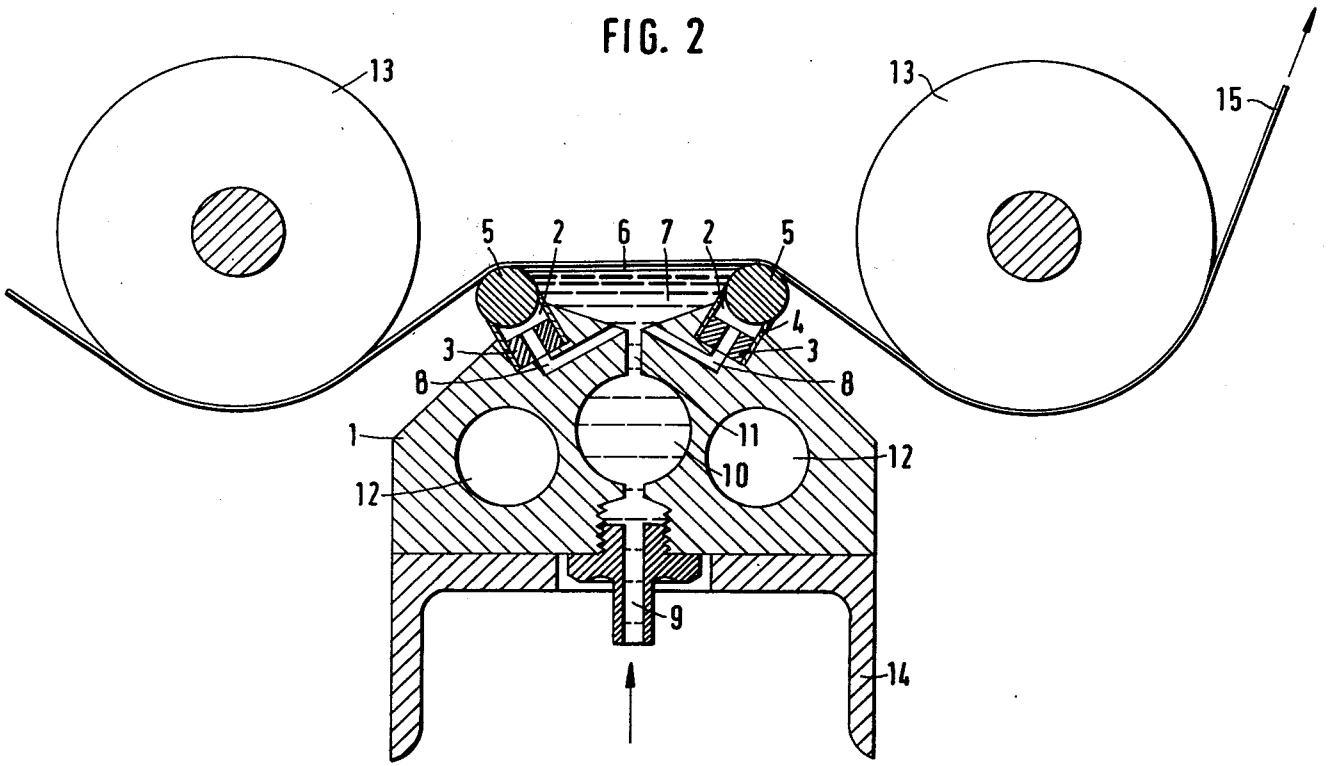
FIG. 2 schematically shows, in side view in cross-section, a preferred embodiment of the device and its mode of operation.

As may be seen from FIG. 2, the device according to the invention consists, in the preferred embodiment, of a prismatic unitary base block 1 which, in order to avoid corrosion, is preferably made of special or stainless steels. Two channels 2 of rectangular cross-section are machined in adjacent areas of the base block 1, with the channel openings being inclined away from the trough in the manner illustrated. The inclined position of the channels results from the requirement that the rod should be centered precisely in its support. Accordingly, the resultant of the parallelogram of forces formed by the magnitude and direction of the forces acting on the rod must be directed substantially to the center of the channels. Narrow, thin metal doctor strips 4 are held in the channels 2 by clamping strips 3, which can be made either of steel or or plastic. With a view to corrosion, which cannot be excluded, and to possible catalytic reactions with the coating agent, it is, here again, advisable to use, in particular, stainless steel sheet. The metal doctor strips 4 perform two functions. On the one hand, they must support the rotating doctor rod 5 over its entire lenght and hold it in its prescribed position, and they must also keep it free from any solid particles. To intensify the process of cleaning the doctor rods, the latter are, in addition, externally flushed. For this, the actual coating substance, for example a polyvinylidene dispersion, is used as a flushing and wetting agent. This dispersion arrives on the applicator trough 7 which is delimited by the doctor rods 5 and by the end plates or side covers 6 (see FIG. 3) which latter have to be matched to the coating width, via connecting bores 8 into the channels 2, through which it flows axially in the direction of the two lateral outlet orifices. In this process, not only is the doctor rod wetted and under certain circumstances also temperature-controlled, but also the particles of solid and of dirt scraped off the rod by the doctor strips, acting like a knife, are flushed away deliberately. The device is, in this case, charged with coating substance via a bore 9, which again enters a pressure compensating channel 10 extending over substantially the entire width of the base block 1. This channel communicates with the applicator trough 7 via a narrow slit 11 that extends over the width of the trough. Temperature conditioning, that is to say heating or cooling, of the entire device is possible via the bores 12 which can carry the heat exchange medium.

The hold-down rolls 13 are vertically adjustable and serve to regulate the wrap-round angle of the web on the doctor rods 5. Of course, this also can be achieved, in the case of fixed-position rolls, by an adjustment of the entire coating unit mounted on the height adjustment device 14.

Figure 3:
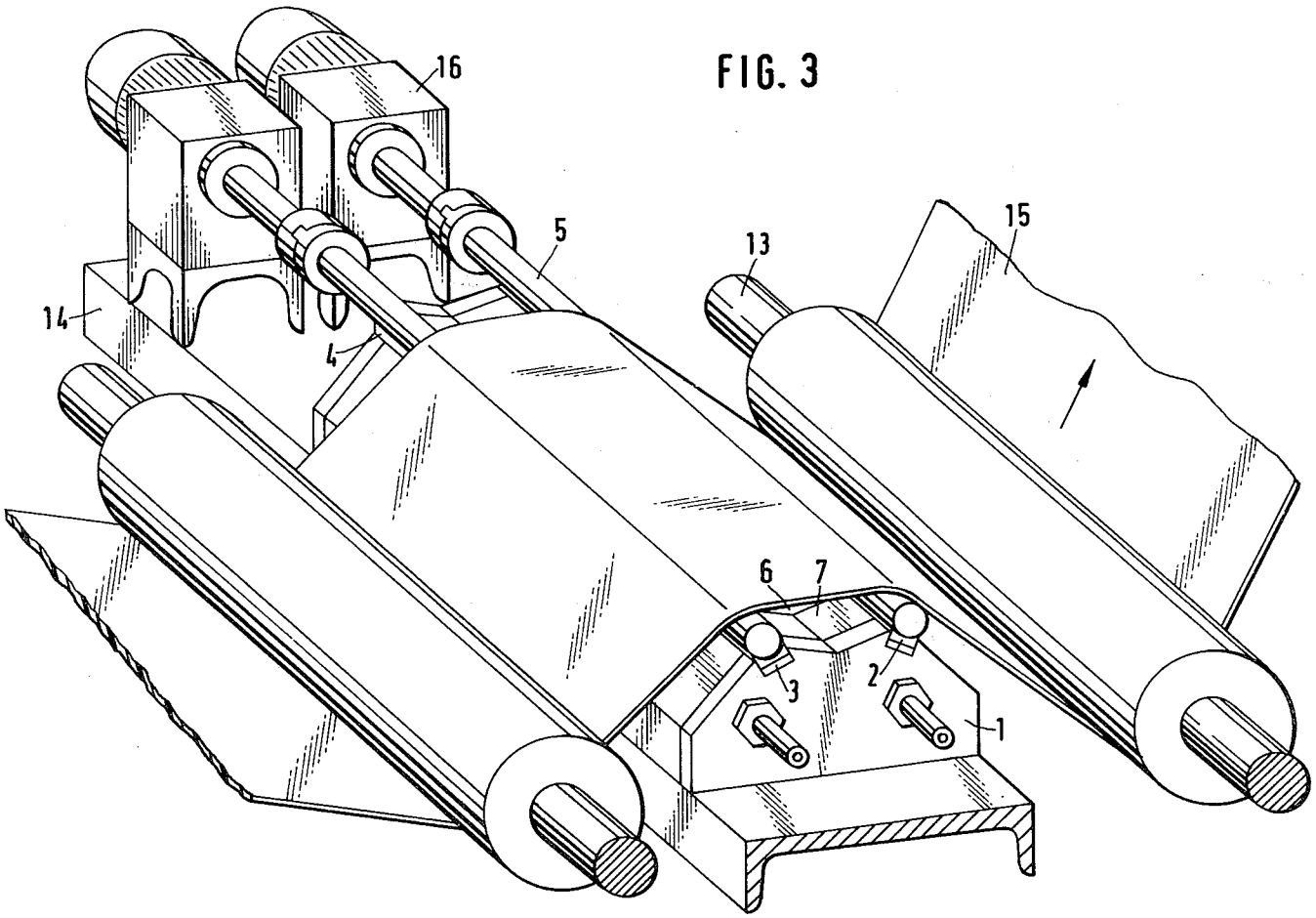
FIG. 3 shows a perspective view of the device according to FIG. 2.

In FIG. 3, the end plates 6 and the drives 16 for the doctor rods 5 can also be seen. In other respects, the same numerals represent the same constructional parts.

The coating operation using the device according to the invention, illustrated with the aid of FIGS. 2 and 3, proceeds as follows:

The coating substance is fed via the feed bores 9 into the pressure compensating channel 10 by means of a unit of adjustable conveying capacity, for example a suitable pump or an accumulator vessel. From the channel 10, it uniformly fills the applicator trough 7 via the slit 11, from which trough uncontrollable lateral loss of the coating agent is prevented by the plates 6. By lowering the rods 13 into the working position shown, the web 15 to be coated, which now runs over the doctor rods 5, now closes the applicator trough 7. The coating substance which is in this way flushed onto the web is immediately reduced to the desired amount on the exit doctor rod 5 which is rotated, as desired, in or counter to the web travel, by means of a variable-speed gearbox 16. Only a small part of the coating substance passes from the applicator trough 7 via the bores 8 into the channels 2 of the doctor rod support. When the material circulates through the channels 2, on the one hand the doctor rods 5 are wetted, whereby the deposition of solid particles or dirt particles is avoided, whilst on the other hand, the coating agent flushes the foreign bodies, scraped off the rods by the doctor strips 4, away out of the channels. The amount which overflows is collected, cleaned and returned to the coating process. Since the coating substance is obtained in an absolutely bubble-free and foam-free condition — the substance is not churned up, even at the highest machine speeds — by any rotating components present in the applicator system — it is in principle possible to dispense with auxiliary units which in other cases are necessary, such as, for example, the foam settling vessels or the like customary with polyvinylidene coating.

Though the first doctor rod 5 (towards the left in FIG. 2) exerts virtually no influence on the adjustment of the amount of the applied substance, and it will thus be entirely possible to replace it by a rigid edge, it has nevetheless proved to be absolutely necessary to allow this rod to rotate also. In this way the accumulation of the dirt and dust originating from the travelling web of material, and the formation of scratches, is avoided, in contrast to the apparatus described in German Auslegungsschrift No. 1,652,402, in which the web of material to be coated runs over a fixed curved surface.

Figure 4:
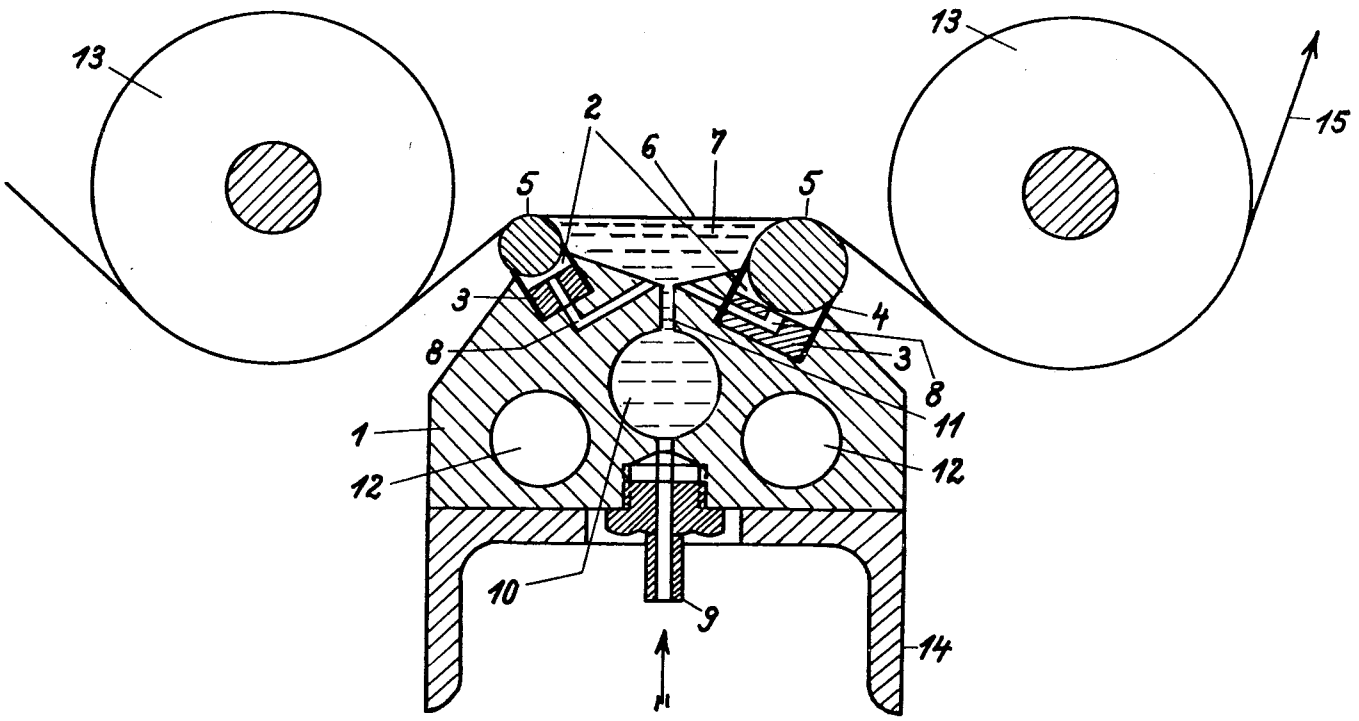
FIG. 4 is similar to FIG. 2 showing different size doctor rods.

In FIG. 4, the embodiment using different size doctor rods 5 is illustrated, showing the larger doctor rod at the rear of the trough 7 in the direction of web feed.

Figure 5:
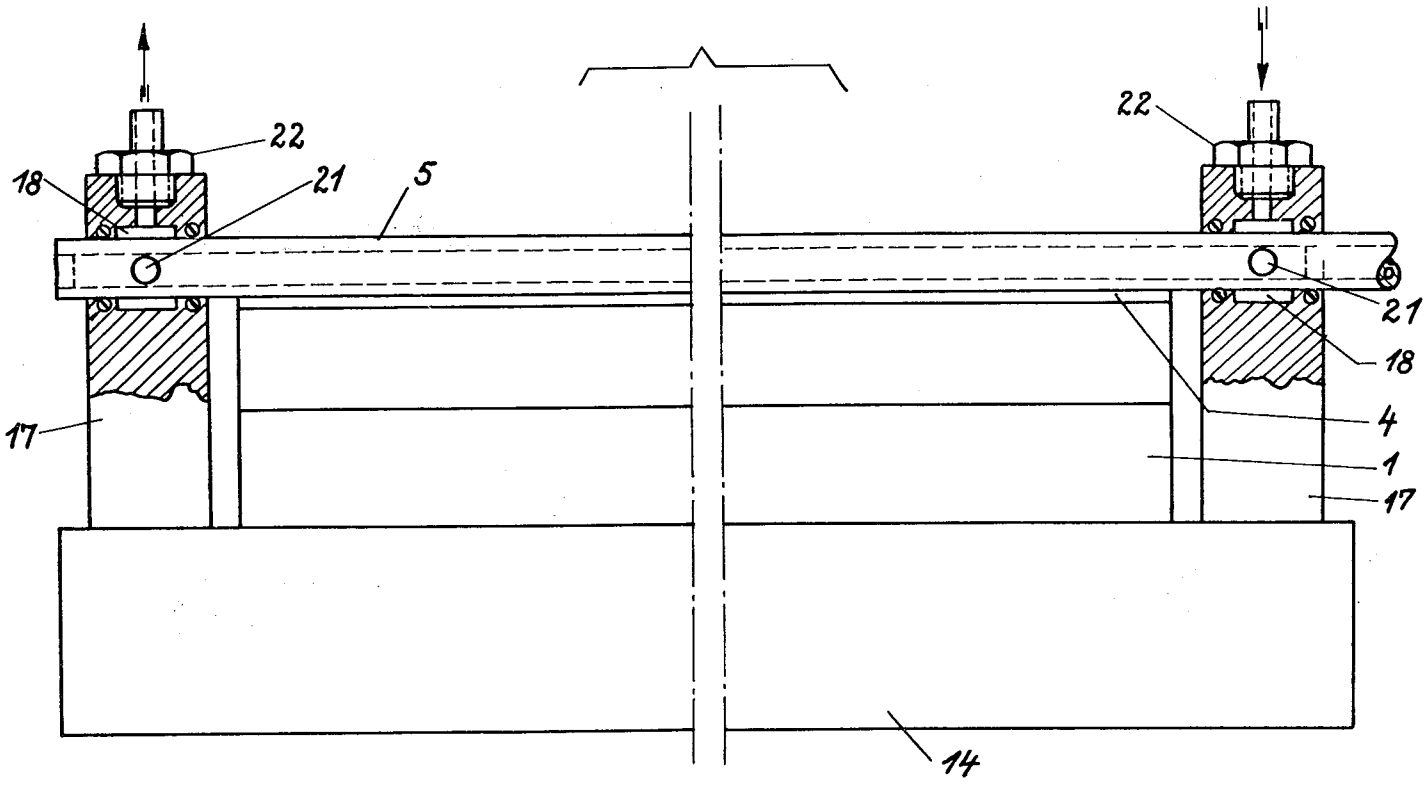
FIG. 5 shows, in end view, tubular doctor rods connected to heating medium supply conduits.

In FIG. 5, doctor rods 5 are shown in tubular form, with the interior of the rods 5 communicating with a heat exchange medium supply 22 adjacent their ends, which are supported in the base element 17 which is provided with an annular orifice 18 through which the heat exchange medium flows into orifice 21 in rods 5 while the latter are rotating.

For the drive of the doctor rods, it is advisable to use variable-speed gearboxes with reversible direction of rotation. In order to exclude an effect on the required precise rotation of the doctor rods and of the drive units, the use of elastic connecting elements such as couplings, cardan joints or universal joints is to be preferred.

The application weights achievable with the described mode of operation of the device are dependent on the size of the adjusting rods employed, in addition to many other factors. Customary coating weights of the order of magnitude of 3 to 6 $g/m^2$ can, for example, be realized successfully with adjustment rods of 8 to 12 mm diameter. Where larger amounts are applied, rods with diameters of up to 50 mm become necessary.

The particular technical advantage of the described device according to the invention is to be seen in the manner of application of the coating agent without any moving transfer elements, such as rolls and the like, and in the adjustment of the amount, which follows directly thereafter. This provides the preconditions for processing particularly difficult liquid coating substances of all kinds.

What is claimed is:

1. Apparatus for continuously applying a flowable coating agent to moving web material of predetermined width comprising:

a coating agent applicator trough extending widthwise across the path of travel of the moving web;

means for supplying coating agent to the trough;

first and second rotatable doctor rods extending parallel to the width of the trough and located along both sides thereof, the doctor rods extending beyond the adjacent sides of the trough so that they form in effect a part of the sidewall of the trough;

support means for the doctor rods comprising channels extending parallel to the rods, the channels having openings across which the doctor rods lie, said channel openings being of lesser width than the doctor rod diameters and said channels having a pair of narrow edge areas in contact with the doctor rods during operation of the apparatus; and means for guiding a tensioned web to be coated across the first doctor rod, across the applicator trough and then over the second doctor rod, whereby coating material picked up by the web surface facing the trough is wiped to a desired thickness by the second doctor rod in the path of travel of the moving web.

2. The apparatus according to claim 1, wherein the web guiding means is arranged to guide the tensioned web over the doctor rods with a predetermined wrap-around angle, and the channel openings are inclined to face away from the trough a predetermined amount, whereby, during operation, the resultant of the forces applied to each of the doctor rods by the moving web is directed substantially towards the center of each channel and urges the doctor rod into contact with its respective channel edge areas.

3. The apparatus according to claim 1, wherein each channel is rectangular in cross-section.

4. The apparatus according to claim 1, wherein each channel has sidewalls and the said narrow edge areas of each channel comprise doctor strips that extend parallel to and along the entire length of the channel sidewalls, and project beyond the channel sidewalls a predetermined amount.

5. The apparatus according to claim 4, wherein the doctor strips are from 0.02 to 0.5 mm in thickness, and project beyond the channel sidewalls between 0.1 to 3.0 mm.

6. The apparatus according to claim 4, wherein the doctor strips are made of springy material.

7. The apparatus according to claim 4, wherein the doctor strips are retained in the channels by removable fastener means.

8. The apparatus according to claim 1, including drive means for driving the doctor rods in rotation.

9. The apparatus according to claim 1, including drive means for driving the doctor rods in counterrotation relative to each other, with the areas of the doctor rods opposite their respective channels moving away from each other during such rotation.

10. The apparatus according to claim 1, said doctor rods having a diameter of between 5 to 50 mm.

11. The apparatus according to claim 1, wherein the doctor rods have different diameters, said second doctor rod having a greater diameter than said first doctor rod.

12. The apparatus according to claim 1, including a unitary base block; said trough and channels being disposed in adjacent areas of said block.

13. The apparatus according to claim 12, including bores in said block for providing communication between said trough and channels.

14. The apparatus according to claim 13, including a lateral outlet orifice from the channel whereby coating agent supplied to the trough can circulate through the channel lengthwise thereof.

15. The apparatus according to claim 12, including a coating agent supply bore in said base block for enabling the supply of coating agent to said trough from an external source.

16. The apparatus according to claim 15, including a pressure equalizing conduit extending along the length of the trough disposed between the coating agent supply bore and the trough, said pressure equalizing conduit communicating with the trough over its entire length, and with said coating agent supply bore.

17. The apparatus according to claim 12, wherein said base block is metal and including heat exchange conduits in said base block and said doctor rods for carrying heat exchange medium.

18. The apparatus according to claim 12, said base block being moveable relative to the web guide means in a manner according to which the angle of wrap of the web about the doctor rods is varied.

19. The apparatus according to claim 1, including end plates at opposite ends of the trough to contain the coating agents widthwise of the trough.

* * * * *